US007231923B2

(12) United States Patent
Adiga et al.

(10) Patent No.: US 7,231,923 B2
(45) Date of Patent: Jun. 19, 2007

(54) SMOKING ARTICLE INCLUDING A CATALYTIC SMOKE REFORMER

(75) Inventors: Kayyani C. Adiga, Macon, GA (US); Rufus H. Honeycutt, China Grove, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 5 days.

(21) Appl. No.: 10/889,843

(22) Filed: Jul. 13, 2004

(65) Prior Publication Data

US 2006/0011205 A1 Jan. 19, 2006

(51) Int. Cl.
*A24F 1/22* (2006.01)

(52) U.S. Cl. ..... 131/194; 131/334; 131/195; 131/335

(58) Field of Classification Search ..... 131/334, 131/335, 336, 337, 360, 331, 194, 195
See application file for complete search history.

(56) References Cited

U.S. PATENT DOCUMENTS 3,368,566 A * 2/1968 Avedikian ..... 131/334
3,416,540 A 12/1968 Lidums
3,759,268 A * 9/1973 Plourde ..... 131/336
3,964,493 A 6/1976 Baker
4,016,887 A 4/1977 Uroshevich
4,142,534 A * 3/1979 Brantl ..... 131/331
4,215,708 A * 8/1980 Bron ..... 131/333
4,317,460 A 3/1982 Dale et al.
4,397,321 A 8/1983 Stuetz
4,848,376 A 7/1989 Lilja et al.
4,907,606 A 3/1990 Lilja et al.
5,040,551 A 8/1991 Schlatter et al.
5,050,621 A * 9/1991 Creighton et al. ..... 131/331

(Continued)

FOREIGN PATENT DOCUMENTS

EP 0352106 1/1990

(Continued)

OTHER PUBLICATIONS

Browne, Colin L., The Design of Cigarettes, Celanese Fibers Marketing Company, Second Edition, p. 4.*

(Continued)

*Primary Examiner*—Dionne W. Mayes
(74) *Attorney, Agent, or Firm*—Charles G. Lamb; Charles I. Sherman; Middleton Reutlinger

(57) ABSTRACT

A smoking article includes a tobacco rod in axial alignment with a filter section with a catalyst bed disposed between the tobacco rod and the filter section. The catalyst bed may be heated from an external portable heating source or may be heated by the internal evolving gases of combustion of the tobacco.

5 Claims, 2 Drawing Sheets

U.S. PATENT DOCUMENTS

| | | | | |
|---|---|---|---|---|
| 5,076,294 | A * | 12/1991 | Kramer | 131/331 |
| 5,211,684 | A | 5/1993 | Shannon et al. | |
| 5,240,014 | A * | 8/1993 | Deevi et al. | 131/334 |
| 5,392,793 | A | 2/1995 | Molloy | |
| 5,446,003 | A | 8/1995 | Augustine et al. | |
| 5,657,772 | A | 8/1997 | Duke et al. | |
| 5,671,758 | A | 9/1997 | Rongved | |
| 5,727,573 | A | 3/1998 | Meier et al. | |
| 6,748,955 | B2 | 6/2004 | Snaidr et al. | |
| 6,789,547 | B1 * | 9/2004 | Paine, III | 131/334 |
| 6,823,873 | B2 | 11/2004 | Nichols et al. | |
| 6,857,431 | B2 * | 2/2005 | Deevi et al. | 131/334 |

FOREIGN PATENT DOCUMENTS

| | | |
|---|---|---|
| GB | 2 026 842 | 11/1978 |

OTHER PUBLICATIONS

Von H. Borowski Und F. SeeHofer, Temperaturvertauf des hauptrauches im Cigarettenstummel Wahrend des Rauchens, Research & DevelopmentLiterature, Dec. 1962, Heft 9, Wissenschaftliche Abtellung der British American Tobacco Co. (C.E.) GmbH, UK (GB).

* cited by examiner

SMOKING ARTICLE INCLUDING A CATALYTIC SMOKE REFORMER

BACKGROUND OF THE INVENTION

This invention relates to a smoking article which includes a catalyst bed therein and more particularly to a smoking article which reforms the mainstream smoke of a smoking article by heating a selected catalyst disposed within the smoking article.

In the combustion of tobacco in a smoking article, many difference gaseous constituents are released during the combustion. Some of these gaseous components are toxic, others are not. Most cigarette products include a cellulose acetate filter on the mouth end of the cigarettes to remove a substantial percentage of the solid particulates as well as the removal of a large quantity of condensing gases evolved from the combustion of the tobacco. It is also become common place to use activated charcoal in combination with a cellulose acetate filter for the removal of noxious gases and particulate materials in the smoke stream.

In U.S. Pat. No. 5,657,772 to Duke et al, Duke et al teaches a filter for a smoking article which incorporates particles coated with platinum for reducing selective volatiles which are present in the mainstream smoke in a smoking article. Moreover, in U.S. Pat. No. 5,211,684 to Shannon et al, a smoking article is taught which contains a catalytic composition as part of the fuel element for reducing carbon monoxide in mainstream smoke from combustion of tobacco in a smoking article.

SUMMARY OF THE INVENTION

It is an object of the present invention to provide a smoking article which includes a catalytic smoke reformer therein.

It is another object of the present invention to provide a smoking article which uses a catalyst as a distinct component of the smoking article which is heated slightly above ambient temperature in order to enhance smoke reformer activity.

It is even a further object to use catalytic combustion of whole smoke as the heat source for aerosol formation and thereby generate a chemically simple smoke for a consumer.

It is also an object to use a catalyst in a cigarette to combust carbon monoxide.

More particularly, the present invention provides a smoking article which includes a tobacco rod in axial alignment with a filter section with a catalyst bed disposed between the tobacco rod and the filter section, the catalyst bed being maintained at a preselected temperature above 100° C.

In the present invention, a cooling chamber may be disposed between the catalyst bed and the filter and the catalyst bed may be in heat communication with a heating source, such as a heating pad which circumscribes the catalyst, or the tobacco rod may be provided with a centrally disposed channel therein which extends the longitudinal length of the tobacco rod for providing heating smoke or smoke at an elevated temperature of at least 100° C. as the means for providing heat to the catalyst bed. The portable heating pad usually consists of a self-sustaining solid-solid or a solid-liquid exothermic reactor which is packed in a disposable wrapper that envelopes a catalyst bed. Even further, flavorings may be added to the smoking article and in one particular embodiment may be disposed between the catalyst bed and the filter section.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENTS

Figure 1:
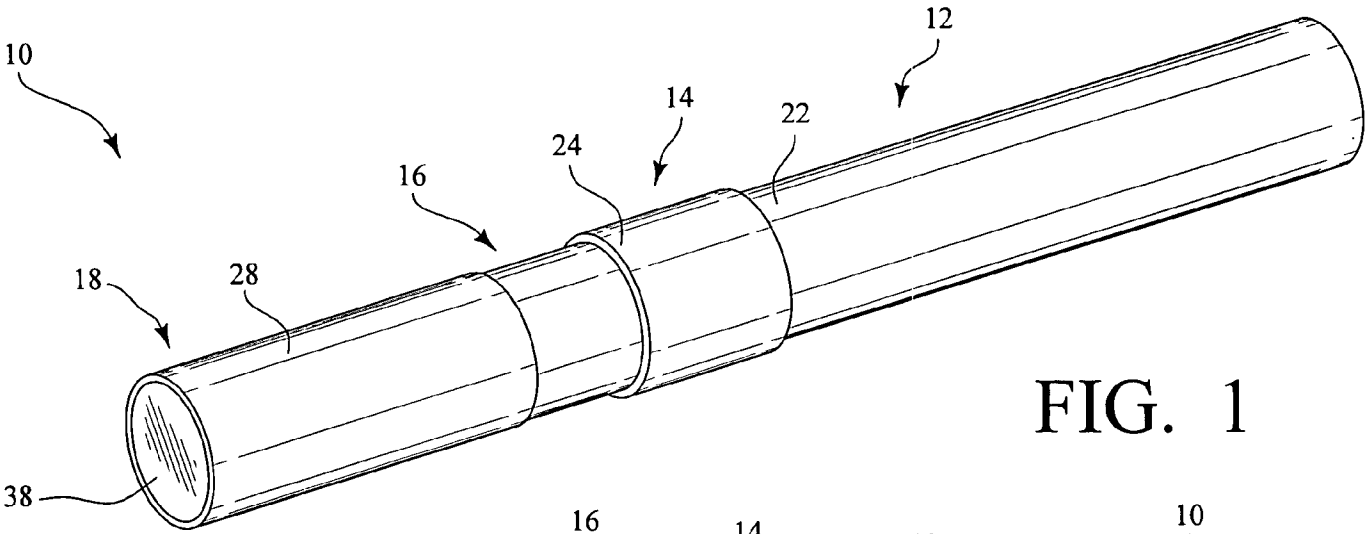
FIG. 1 is a perspective view of one preferred embodiment of the smoking article of the present invention.
Figure 2:
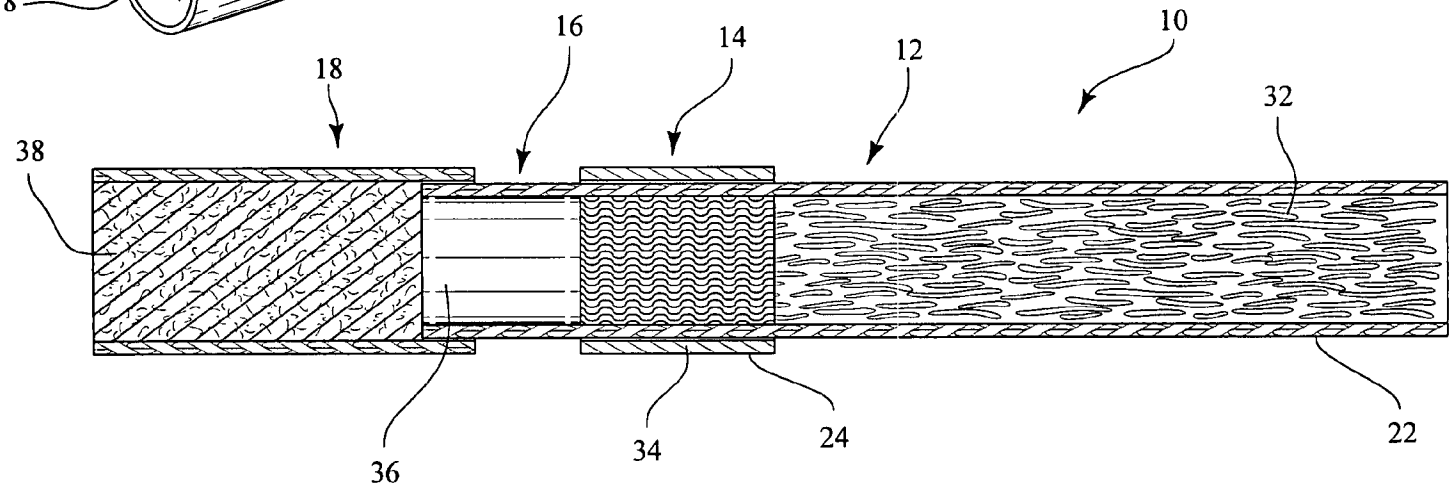
FIG. 2 is a cross-sectional side elevation of the smoking article of FIG. 1.

As shown in FIGS. 1 and 2, a smoking article 10 is comprised of a tobacco section 12, a heated catalysis section 14, a cooling section 16, and a filter section 18. A cigarette wrapper 22 encases tobacco 32 and extends towards the mouth end of the cigarette. Cigarette wrapper 22 also encases a cooling chamber 36 adjacent to the filter section 18. An external heat source, such as a heating pad 24, circumscribes the catalyst bed 34. The portable heating pad 24 generally includes a self-sustaining solid-solid or solid-liquid exothermic reactor packed in a disposable wrapper. The catalyst bed 34 is generally in the form of meshes, honeycombed structures, granules, and the like. The particular catalyst for making up the meshes or honeycombed structures is determined by the specific smoke components which are to be reformed. The ability to alter specific smoke components depends on the nature of the catalyst, the effective surface area of the catalyst, and its surface temperature. For example, oxidation/reduction catalyst reduce NOx and oxide CO. Low temperature CO oxidation catalyst include base and noble metal oxides. Platinum and/or palladium metals and metal alloys coated on metal substrates are usable for oxidation-reduction catalyst. The degree of conversion of the smoke components depends on the specific type catalyst and reaction temperature employed. Depending upon the desired extent of smoke chemistry modification, the catalyst bed may include a plurality of different types of catalysts.

In the smoking of a smoking article, as set forth in FIGS. 1 and 2, the lighting end or tobacco end of the smoking article 10 is lit and the smoke passes from the tobacco section 12 into the catalyst section 14 which is heated by a heating pad 24 to at least 100° C. and controlled in a desired temperature range wherein selected smoke components reform as they pass through the catalyst bed 34. The mainstream smoke, including the reformed smoke components, is then cooled in the cooling section 16 prior to entering the filter section 18. In the filter section 18, the particulates and condensible materials are removed from the smoke stream prior to entering the mouth of the smoker.

Figure 3:
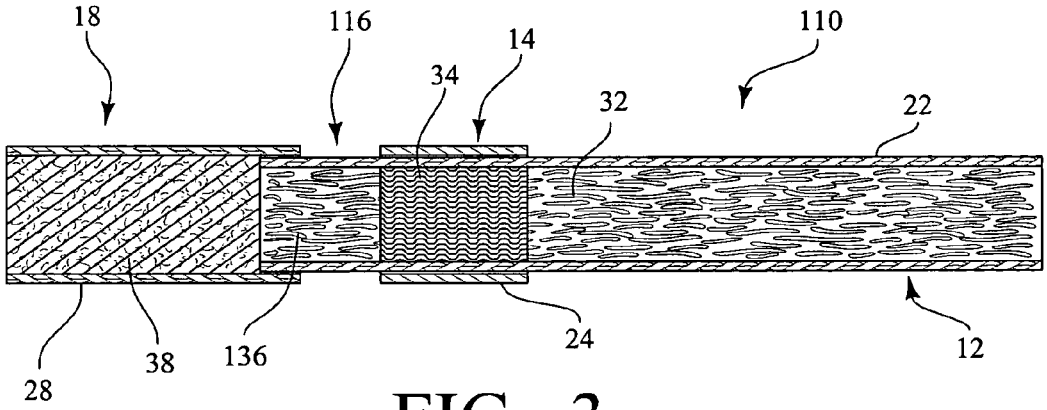
FIG. 3 is a cross-sectional view of a second embodiment of the present invention.

In FIG. 3 is shown a second embodiment of the present invention wherein a smoking article 110 differs from the smoking article 10 in that a flavor section 116 is disposed between the heated catalyst section 14 and the filter section 18. The flavor section 116 includes a flavor source 136 which may be tobacco or any other flavor source which will be vaporized upon contact with the mainstream smoke which is the by-product of combustion of the tobacco 32 in the tobacco section 12.

Figure 4:
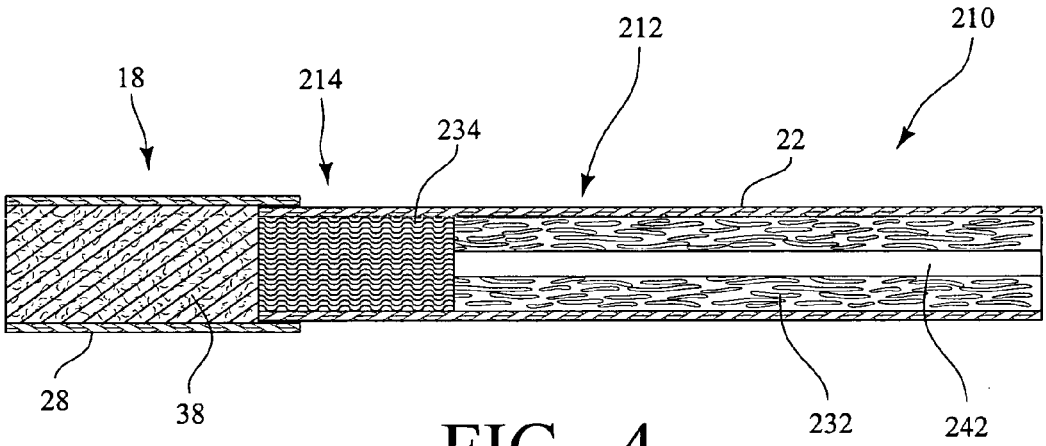
FIG. 4 is a cross-sectional view of a third embodiment of the present invention; and, FIG. 5 is a cross-sectional view of a fourth embodiment of the present invention.

In FIG. 4 is shown a smoking article 210 which differs from the smoking article 10 and 110 of FIGS. 2 and 3, respectively, in that the tobacco section 212 is provided with tobacco 232 and a central hollow section 242 which extends from the terminating or lighting end of tobacco section 212 to the catalyst bed 234. The mainstream smoke from the tobacco section 212 flows through the channel 242 and upon contacting the catalyst bed 234, catalytic after-burning takes place resulting in the oxidation of CO and reduction of NOx. The quality of the reform smoke depends, however, on the specific catalyst and its temperature.

Figure 5:
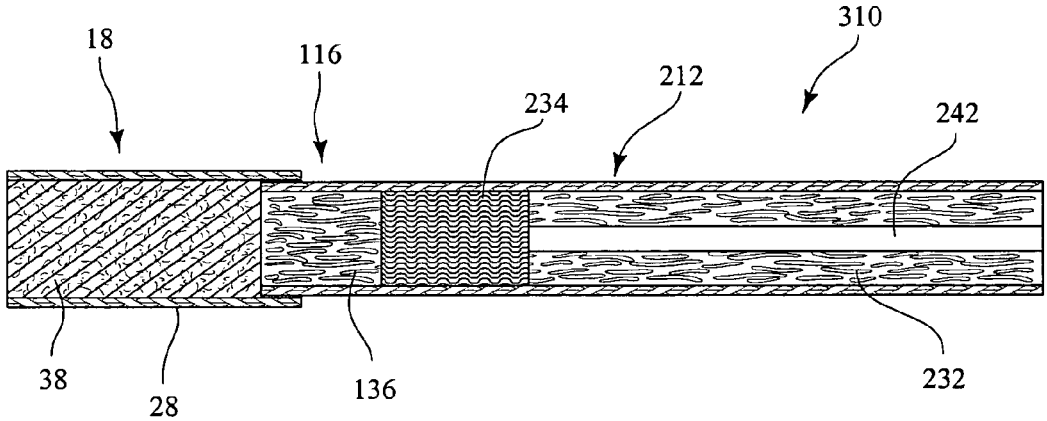

In FIG. 5 is another embodiment of the present invention. The smoking article 310 is a modification of the smoking article 210 of FIG. 4 wherein a flavor section 116, including a flavor source, such as tobacco 136, is disposed between the catalyst 234 and the filter section 18.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A smoking article comprising:

a tobacco rod in axial alignment with a filter section; and, a catalyst bed disposed between said tobacco rod and said filter section, said catalyst bed being in heat communication with a heat source comprising a heating pad circumscribing only said catalyst bed which heats the catalyst during use of the smoking article to a temperature above 100° C.

2. The smoking article of claim 1 including a cooling chamber disposed between said catalyst bed and said filter section.

3. The smoking article of claim 1 including a flavoring section disposed between said catalyst bed and said filter section.

4. The smoking article of claim 3, said flavor section being tobacco.

5. The smoking article of claim 1 including a cooling section being disposed between said catalyst bed and said filter section, and a flavor section disposed between said catalyst bed and said filter section.

* * * * *